US008736508B2

(12) United States Patent
Chou

(10) Patent No.: US 8,736,508 B2
(45) Date of Patent: May 27, 2014

(54) ELECTRONIC DEVICE AND ANTENNA THEREOF

(75) Inventor: Chen-Yu Chou, New Taipei (TW)

(73) Assignee: Wistron Corp., New Taipei (TW)

( * ) Notice: Subject to any disclaimer, the term of this patent is extended or adjusted under 35 U.S.C. 154(b) by 434 days.

(21) Appl. No.: 13/283,290

(22) Filed: Oct. 27, 2011

(65) Prior Publication Data

US 2012/0105297 A1 May 3, 2012

(30) Foreign Application Priority Data

Nov. 2, 2010 (TW) ..... 99137594 A

(51) Int. Cl.
*H01Q 1/48* (2006.01)

(52) U.S. Cl.
USPC ..... 343/848; 343/702

(58) Field of Classification Search
USPC ..... 343/702, 848, 895
See application file for complete search history.

(56) References Cited

U.S. PATENT DOCUMENTS

| | | | | |
|---|---|---|---|---|
| 3,852,759 | A * | 12/1974 | Felsenheld et al. | 343/729 |
| 7,158,819 | B1 * | 1/2007 | Pulimi et al. | 455/575.5 |
| 7,583,228 | B2 * | 9/2009 | Tsai et al. | 343/702 |
| 7,817,103 | B2 * | 10/2010 | Kersten et al. | 343/895 |

FOREIGN PATENT DOCUMENTS

| | | | |
|---|---|---|---|
| CN | 1783580 | A | 6/2006 |
| GB | 2328084 | A | 2/1999 |
| TW | 200840143 | A | 10/2008 |

OTHER PUBLICATIONS

China Patent Office, Office Action, Patent Application Serial No. 201010534736.9, Jan. 26, 2014, China.
China Patent Office, Office Action, Patent Application Serial No. 201010534736.9, Jul. 2, 2013, China.

* cited by examiner

*Primary Examiner* — Tan Ho

(57) ABSTRACT

An antenna for transmitting a wireless signal is provided. The antenna includes a radiator and a ground structure. The ground structure surrounds the radiator. The ground structure includes a low-band spiral portion, a band separation portion and a high-band spiral portion. The low-band spiral portion and the high-band spiral portion are respectively connected to two ends of the band separation portion.

16 Claims, 4 Drawing Sheets

ELECTRONIC DEVICE AND ANTENNA THEREOF

CROSS REFERENCE TO RELATED APPLICATIONS

This Application claims priority of Taiwan Patent Application No. 099137594, filed on Nov. 2, 2010, the entirety of which is incorporated by reference herein.

BACKGROUND OF THE INVENTION

1. Field of the Invention

The present invention relates to an antenna, and in particular relates to a reverse helical beam antenna.

2. Description of the Related Art

An E-book is popularly utilized as a medium for electronic document reading. Nowadays, E-books have output interfaces such as a screen and an amplifier, and is gradually utilized for watching digital television programs.

Contractible digital television antennas and externally connected digital television antennas are utilized in conventional E-books. The contractible digital television antenna is made up of expensive metal materials, and costs thereof have increased. The externally connected digital television antennas have improved transmission; however, externally connecting wire of the externally connected digital television antenna may cause some inconvenience.

BRIEF SUMMARY OF THE INVENTION

An antenna for transmitting a wireless signal is provided. The antenna includes a radiator and a ground structure. The ground structure surrounds the radiator. The ground structure includes a low-band spiral portion, a band separation portion and a high-band spiral portion. The low-band spiral portion and the high-band spiral portion are respectively connected to two ends of the band separation portion.

The antenna of the embodiment of the invention satisfies digital television signal transmission requirements with decreased dimensions. The antenna of the embodiment can be utilized in an electronic device and provides improved transmission. The electronic device can be an E-book, notebook or other electronic devices.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
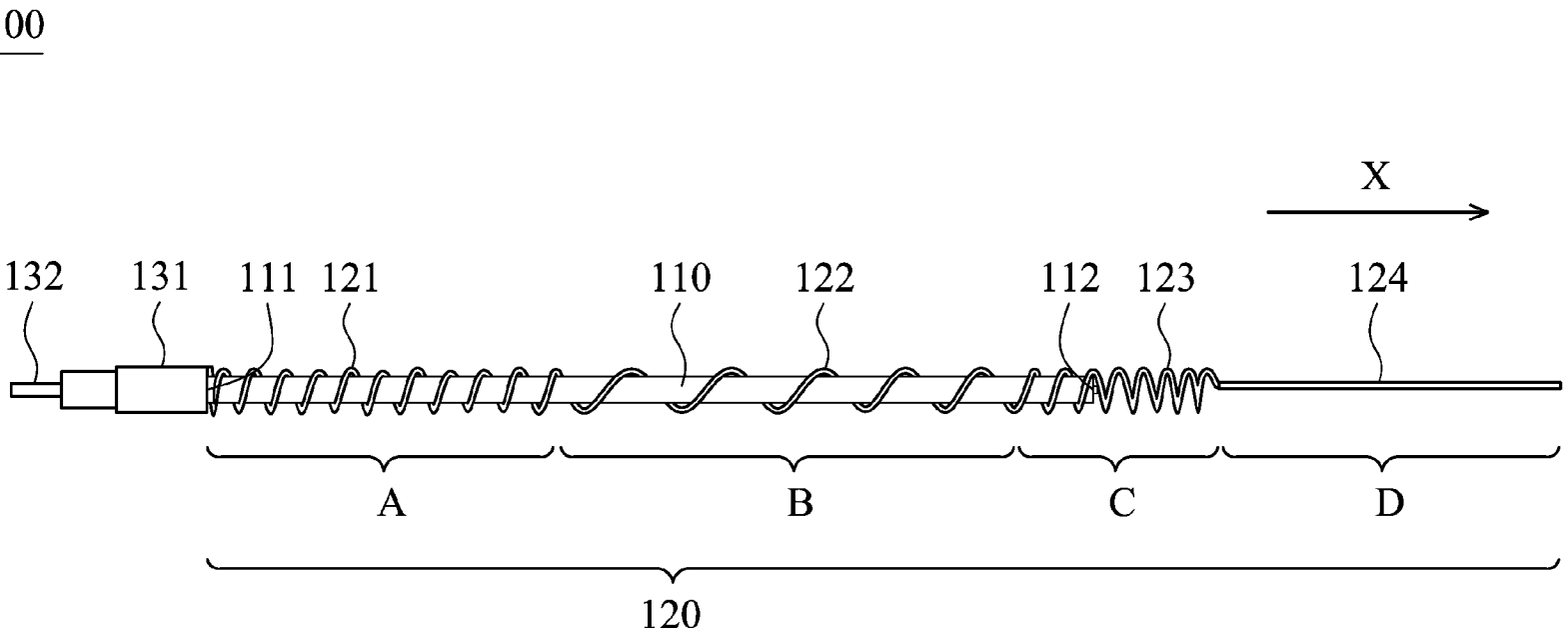
FIG. 1 shows an antenna of an embodiment of the invention for transmitting a wireless signal.

FIG. 1 shows an antenna 100 of an embodiment of the invention for transmitting a wireless signal. The antenna 100 comprises a radiator 110, a ground structure 120, a ground conductor 131 and a feed conductor 132. The radiator 110 is longitudinal and extends toward a first direction X, an end 111 of the radiator 110 is adjacent to the ground conductor 131, and the other end 112 of the radiator 110 is a free end. The end 111 of the radiator 110 is not electrically connected to the ground conductor 131. The feed conductor 132 is electrically connected to the radiator 110. The ground conductor 131 is electrically connected to the ground structure 120.

The ground structure 120 surrounds the radiator 110, but is separated from the radiator 110. The ground structure 120 comprises a low-band spiral portion 121(A), a band separation portion 122(B) and a high-band spiral portion 123(C). The low-band spiral portion 121(A) and the high-band spiral portion 123(C) are respectively connected to two ends of the band separation portion 122(B). The low-band spiral portion 121(A) is electrically connected to the ground conductor 131.

The band separation portion 122(B) separates the low-band spiral portion 121(A) from the high-band spiral portion 123(C). In this embodiment, the band separation portion 122(B) is spiral, and an extending length (distance between the low-band spiral portion and the high-band spiral portion) of the band separation portion 122(B) is longer than 20 mm to reduce interference between the low-band spiral portion 121(A) and the high-band spiral portion 123(C). In this embodiment, the pitch of the band separation portion 122(B) is 4.5 mm~6.5 mm, and the number of coils thereof is 3~4.

With reference to FIG. 1, the ground structure 120 can further comprise a fine-tuning portion 124(D), connected to the high-band spiral portion 123(C). The fine-tuning portion 124(D) is longitudinal, extending toward the first direction X and parallel to the radiator 110. The fine-tuning portion 124(D) is utilized for fine-tuning the frequency of high-band signals. In this embodiment, the length of the fine-tuning portion 124(D) is about 16~19 mm.

Figure 2:
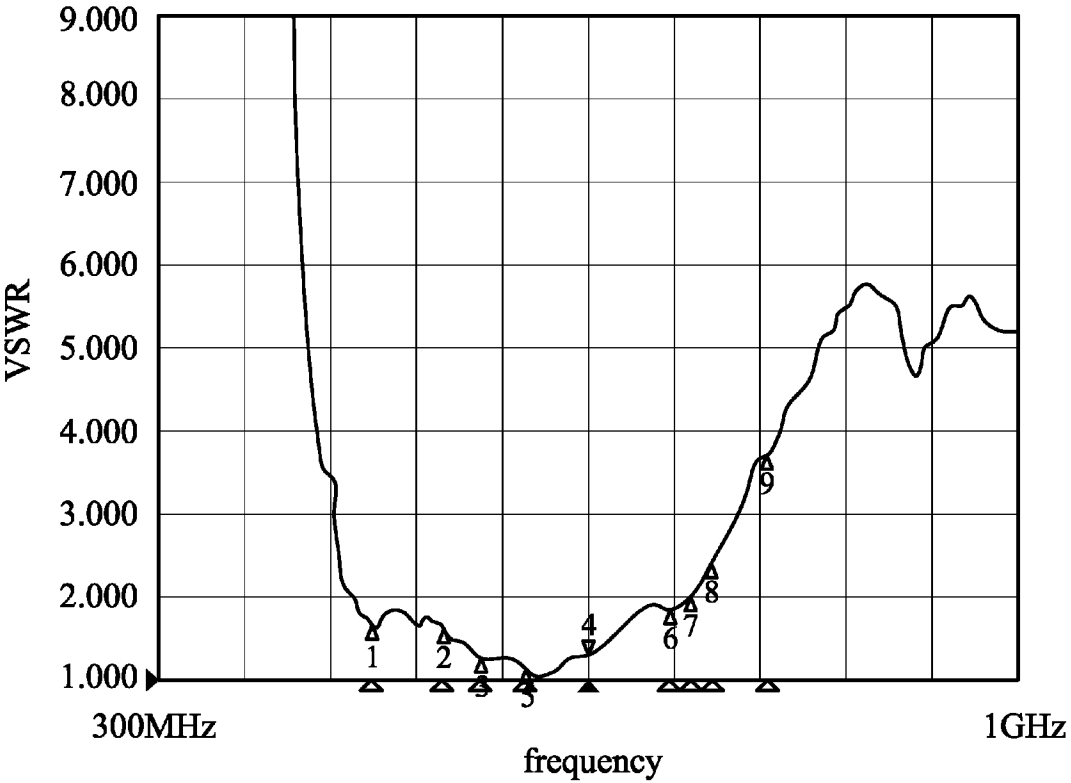
FIG. 2 shows the Voltage Standing Wave Ratio of the antenna of the embodiment of the invention.

In this embodiment, the free end 112 of the radiator 110 is located on a border between the band separation portion 122(B) and the high-band spiral portion 123(C). The length of the radiator 110 is one-eighth of a wavelength of a central frequency of the wireless signal. The central frequency is 620~650 MHz, and the length of the radiator 110 is 57~60 mm. The radiator 110 is electrically connected to the feed conductor (positive electricity), and the ground structure 120 is electrically connected to the ground conductor (negative electricity), and the negative pole (ground structure) therefore surrounds the positive pole (radiator). The bandwidth of the antenna of the embodiment of the invention can be increased by modifying the low-band spiral portion 121(A) and the high-band spiral portion 123(C). FIG. 2 shows the Voltage Standing Wave Ratio of the antenna of the embodiment of the invention, wherein the antenna of the embodiment of the invention satisfies digital television signal transmission requirements with decreased dimensions. In this embodiment, the low-band spiral portion 121(A) transmits wireless signals within 474~560 MHz, the pitch of the low-band spiral portion 121(A) is 1.5 mm~1.8 mm, and the number of coils thereof is 12~16. The high-band spiral portion 123(C) transmits wireless signals within 720~798 MHz, the pitch of the high-band spiral portion 123(C) is 1.3 mm~1.5 mm, and the number of coils thereof is 4.5~6.5.

Figure 3:
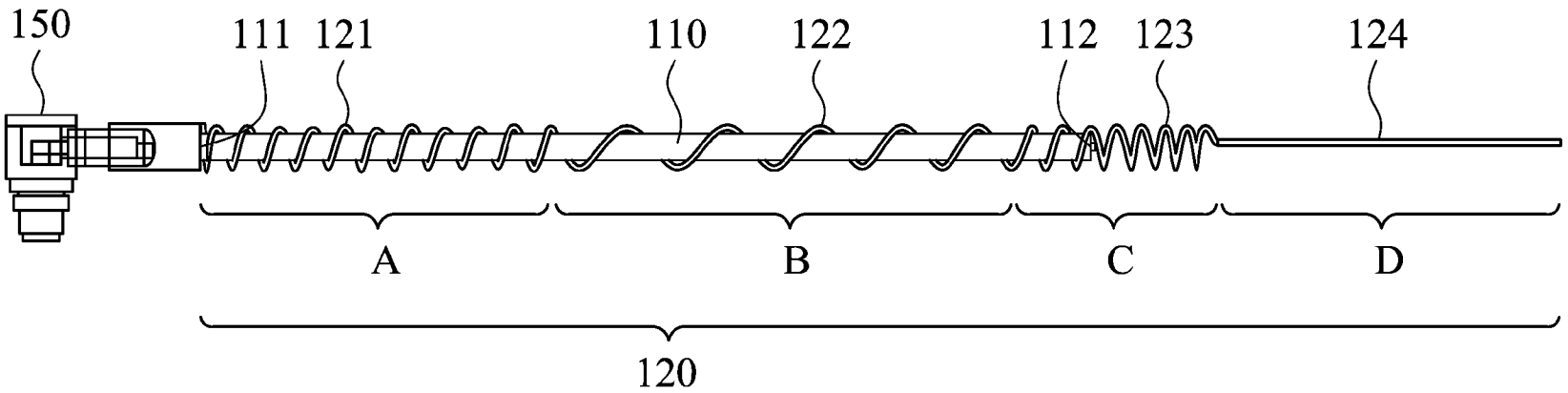
FIG. 3 shows the antenna connected to a joint.

FIG. 3 shows the antenna 100 connected to a joint 150. The signals transmitted by the antenna 100 can be outputted via the joint 150.

Figure 4:
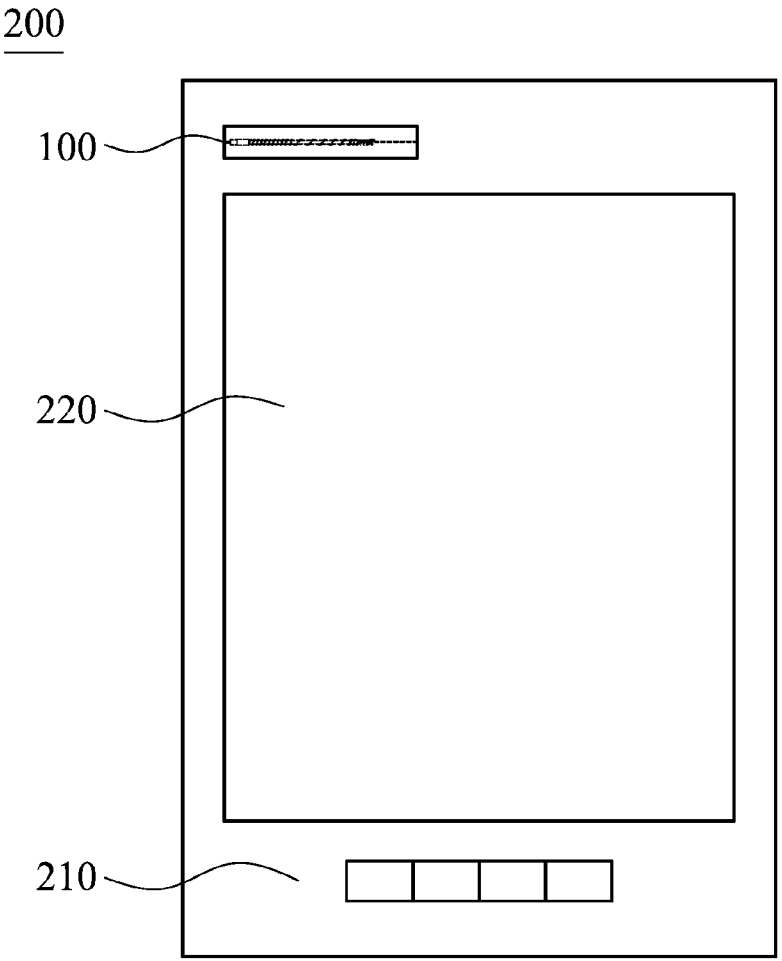
FIG. 4 shows an electronic device utilizing the antenna of the embodiment of the invention.

FIG. 4 shows an electronic device 200 utilizing the antenna 100 of the embodiment of the invention. The electronic device 200 comprises a body 210 and an operation interface 220. The operation interface 220 is disposed on the body 210. The antenna 100 is disposed in the body 210. The electronic device 200 can be an E-book, notebook or other electronic devices. The operation interface 220 can be a touch panel, keyboard, screen or other interfaces.

The antenna of the embodiment of the invention can be disposed on the body or inside of the body of the electronic device, and provides improved transmission.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna for transmitting a wireless signal, comprising:
- a radiator; and
- a ground structure, surrounding the radiator, comprising:
  - a low-band spiral portion;
  - a band separation portion; and
  - a high-band spiral portion, wherein the low-band spiral portion and the high-band spiral portion are respectively connected to two ends of the band separation portion.

2. The antenna as claimed in claim 1, further comprising a ground conductor, wherein the radiator is longitudinal and extends toward a first direction, an end of the radiator is adjacent to the ground conductor, and another end of the radiator is a free end.

3. The antenna as claimed in claim 2, wherein the low-band spiral portion is connected to the ground conductor.

4. The antenna as claimed in claim 2, wherein the band separation portion is spiral.

5. The antenna as claimed in claim 2, wherein the free end of the radiator is located on a border between the band separation portion and the high-band spiral portion.

6. The antenna as claimed in claim 2, wherein the ground structure further comprises a fine-tuning portion, connected to the high-band spiral portion.

7. The antenna as claimed in claim 6, wherein the fine-tuning portion is longitudinal, extending toward the first direction and parallel to the radiator.

8. The antenna as claimed in claim 1, wherein a length of the radiator is one-eighth of a wavelength of a central frequency of the wireless signal.

9. An electronic device, comprising:
- a body;
- an operation interface, disposed on the body; and
- an antenna, disposed on the body or inside of the body, wherein the antenna is utilized for transmitting a wireless signal, comprising:
  - a radiator; and
  - a ground structure, surrounding the radiator, comprising:
    - a low-band spiral portion;
    - a band separation portion; and
    - a high-band spiral portion, wherein the low-band spiral portion and the high-band spiral portion are respectively connected to two ends of the band separation portion.

10. The electronic device as claimed in claim 9, wherein the antenna further comprises a ground conductor, the radiator is longitudinal and extends toward a first direction, an end of the radiator is adjacent to the ground conductor, and another end of the radiator is a free end.

11. The electronic device as claimed in claim 10, wherein the low-band spiral portion is connected to the ground conductor.

12. The electronic device as claimed in claim 10, wherein the band separation portion is spiral.

13. The electronic device as claimed in claim 10, wherein the free end of the radiator is located on a border between the band separation portion and the high-band spiral portion.

14. The electronic device as claimed in claim 10, wherein the ground structure further comprises a fine-tuning portion, connected to the high-band spiral portion.

15. The electronic device as claimed in claim 14, wherein the fine-tuning portion is longitudinal, extending toward the first direction and parallel to the radiator.

16. The electronic device as claimed in claim 9, wherein a length of the radiator is one-eighth of a wavelength of a central frequency of the wireless signal.

* * * * *